US005689855A

United States Patent [19]

Tang

[11] Patent Number: 5,689,855

[45] Date of Patent: Nov. 25, 1997

[54] DOOR HINGE STRUCTURE

[75] Inventor: Jung-Chuan Tang, Yun Lin Shiann, Taiwan

[73] Assignee: Chuan Mau Products Co., Ltd., Yun Lin Shiann, Taiwan

[21] Appl. No.: 766,221

[22] Filed: Dec. 12, 1996

[51] Int. Cl.[6] ..... E05D 7/04

[52] U.S. Cl. ..... 16/235; 16/242

[58] Field of Search ..... 16/235, 233, 236–239, 16/240–246

[56] References Cited

U.S. PATENT DOCUMENTS

| | | | |
|---|---|---|---|
| 1,044,055 | 11/1912 | Johnson et al. | 16/242 |
| 1,336,174 | 4/1920 | Way | 16/242 |
| 1,540,581 | 6/1925 | Way | 16/22 |
| 1,900,081 | 3/1933 | Swerer | 16/242 |
| 1,949,183 | 2/1934 | Roberts | 16/235 |
| 3,832,755 | 9/1974 | Maertin et al. | 16/235 |

*Primary Examiner*—Chuck Y. Mah
*Attorney, Agent, or Firm*—Bucknam and Archer

[57] ABSTRACT

A door hinge structure including a first door hinge and a second door hinge connected between a door panel and a door frame at different elevations, for permitting the door panel to be turned relative to the door frame, each door hinge including two leaves having a respective eccentric hole, two bushings respectively mounted in the eccentric holes of the leaves and fixed in position by a respective tightening up screw and having a respective eccentric through hole, and a pivot pin fastened to the eccentric through holes of the bushings to connect the leaves together, permitting the leaves to be turned relative to each other.

4 Claims, 5 Drawing Sheets

DOOR HINGE STRUCTURE

BACKGROUND OF THE INVENTION

The present invention relates to a door hinge structure comprising two door hinges connected between a door panel and a door frame at different elevations, for permitting the door panel to be turned relative to the door frame, wherein the two leaves of each door hinge can be adjusted relative to each other so that the pitch between the door panel and the door frame can be adjusted forwards, backwards, rightwards, leftwards.

A conventional door hinge is generally comprised of two symmetrical leaves connected together by a pivot pin. The leaves have respective mounting holes adapted for fastening to the door panel or the door frame, and barrels respectively turned about the pivot pin. When the two leaves are respectively fixed to the door panel and the door frame, the door panel is allowed to be turned relative to the door frame. Because the two leaves can only be turned relative to each other, they cannot be adjusted to change the pitch between the door frame and the door panel. If door panel is not accurately installed in the door frame, the pitch between the door panel and the door frame cannot be adjusted without detaching the door panel from the door frame.

SUMMARY OF THE INVENTION

The present invention has been accomplished to provide a door hinge structure which eliminates the aforesaid drawbacks. It is the main object of the present invention to provide a door hinge structure which can be conveniently adjusted to change the pitch between the door frame and the door panel when the door panel is installed in the door frame. According to the present invention, the door hinge structure comprises a first door hinge and a second door hinge connected between a door panel and a door frame at different elevations, for permitting the door panel to be turned relative to the door frame, each door hinge including, two leaves having a respective eccentric hole, two bushings respectively mounted in the eccentric holes of the leaves and fixed in position by a respective tightening up screw and having a respective eccentric through hole, and a pivot pin fastened to the eccentric through holes of the bushings to connect the leaves together, permitting the leaves to be turned relative to each other.

DETAILED DESCRIPTION OF THE PREFERRED EMBODIMENT

Figure 1:
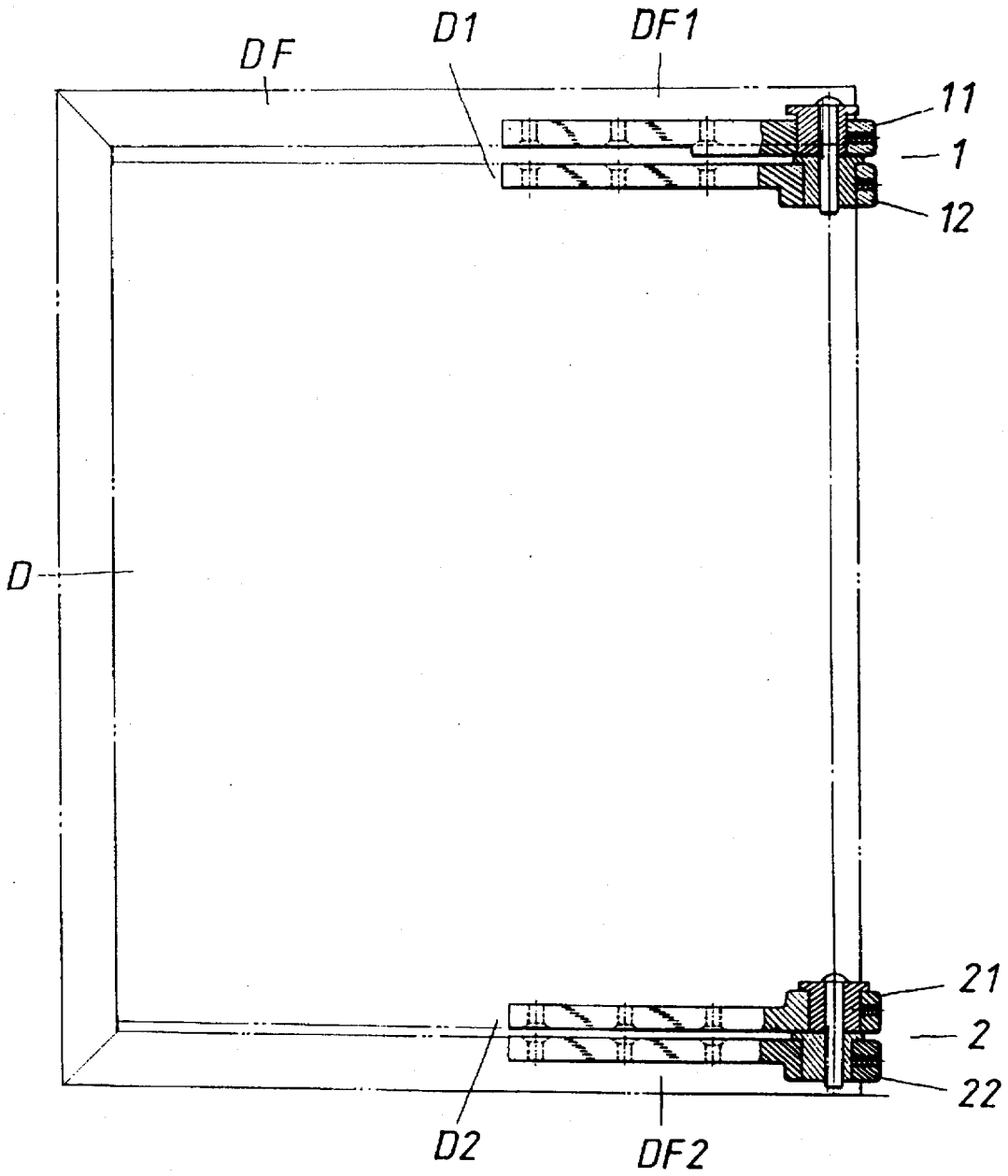
FIG. 1 is an installed view of a door hinge structure according to a first embodiment of the present invention.

FIGS. 1, 3, 4, 5, and 6 show one embodiment of the present invention adapted for use in a door having a doorsill.

This embodiment comprises a top door hinge 1 and a bottom door hinge 2 connected between a door panel D and a door frame DF at different elevations, for permitting the door panel D to be turned relative to the door frame DF.

The top door hinge 1 comprises a first leaf 11 and a second leaf 12 pivotably connected together. The first leaf 11 comprises a flat leaf body 1101 having a plurality of screw holes 1101 adapted for fastening to the top rail DF1 of the door frame DF, a leaf base 1102 obliquely extending from one end of the leaf body 1101 on the same plane. The leaf base 1102 has one end connected to the leaf body 1101 at an angle, and an opposite end terminating in a half-round portion. A vertical axle hole 11021 is made through the half-round portion of the leaf base 1102. The center C2 of the vertical axle hole 11021 is biased from the center C1 of the half-round portion of the leaf base 1102. A horizontal screw hole 11022 is made on the half-round portion of the leaf base 1102, and perpendicularly disposed in communication with the vertical axle hole 11021. A bushing 111 is mounted within the vertical axle hole 11021. A tightening up screw 112 is threaded into the horizontal screw hole 11022 to fix the bushing 111 in place. The second leaf 12 comprises a flat leaf body 1201 having a plurality of screw holes 1201 adapted for fastening to the top side DI of the door panel D, a leaf base 1202 obliquely extending from one end of the leaf body 1201 on the same plane. The leaf base 1202 has one end connected to the leaf body 1201 at an angle, and an opposite end terminating in a half-round portion. A vertical axle hole 12021 is made through the half-round portion of the leaf base 1202. The center C2 of the vertical axle hole 12021 is biased from the center C1 of the half-round portion of the leaf base 1202 (the center of the vertical axle hole 11021 of the first leaf 11 and the center of the half-round portion thereof are respectively in vertical alignment with the center of the vertical axle hole 12021 of the second leaf 12 and the center of the half-round portion of the second leaf 12, therefore same reference codes C1,C2 are used for both leaves 11 and 12). A horizontal screw hole 12022 is made on the half-round portion of the leaf base 1202, and perpendicularly disposed in communication with the vertical axle hole 12021. A bushing 121 is mounted within the vertical axle hole 12021. A tightening up screw 122 is threaded into the horizontal screw hole 12022 to fix the bushing 121 in place. The bushing 111 or 121 has a head 1111 at one end stopped above the leaf base 1102 or 1202, and an eccentric through hole 1113. A headed pivot pin 13 is fastened to the eccentric through holes 1113 of the bushings 111 and 121 to connect the first leaf 11 and the second leaf 12 together. The distance between the eccentric through hole 1113 of the bushing 111 or 121 and the center C1 is equal to the distance between the center C2 of the vertical axle hole 11021 or 12021 and the center C1 of the half-round portion of the leaf 11 or 12.

The bottom door hinge 2 comprises a first leaf 21 and a second leaf 22 pivotably connected together. The first leaf 21 comprises a flat leaf body 2101 having a plurality of screw holes 2101 adapted for fastening to the bottom side D2 of the door panel D, a leaf base 2102 obliquely extending from one end of the leaf body 2101 on the same plane at 45° angle. The leaf base 2102 has one end connected to the leaf body 2101 at 45° angle, and an opposite end terminating in a half-round portion. A vertical axle hole 21021 is made through the half-round portion of the leaf base 2102. The center C3 of the vertical axle hole 21021 is biased from the center CI of the half-round portion of the leaf base 2102. A horizontal screw hole 21022 is made on the half-round portion of the leaf base 2102, and perpendicularly disposed in communication with the vertical axle hole 21021. A bushing 211 is mounted within the vertical axle hole 21021. A tightening up screw 212 is threaded into the horizontal screw hole 21022 to fix the bushing 211 in place. The second leaf 22 comprises a flat leaf body 2201 having a plurality of screw holes 2201 adapted for fastening to the bottom rail DF2 of the door frame DF, a leaf base 2202 obliquely extending from one end of the leaf body 2201 on the same plane at 45° angle. The leaf base 2202 has one end connected to the leaf body 2201 at 45° angle, and an opposite end terminating in a half-round portion. A vertical axle hole 22021 is made through the half-round portion of the leaf base 2202. The center C3 of the vertical axle hole 22021 is biased from the center C1 of the half-round portion of the leaf base 2202. A horizontal screw hole 22022 is made on the half-round portion of the leaf base 2202, and perpendicularly disposed in communication with the vertical axle hole 22021. A bushing 221 is mounted within the vertical axle hole 22021. A tightening up screw 222 is threaded into the horizontal screw hole 22022 to fix the bushing 221 in place. The bushing 211 or 221 has an eccentric through hole 2113. A headed pivot pin 23 is fastened to the eccentric through holes 2113 of the bushings 211 and 221 to connect the first leaf 21 and the second leaf 22 together.

Figure 2:
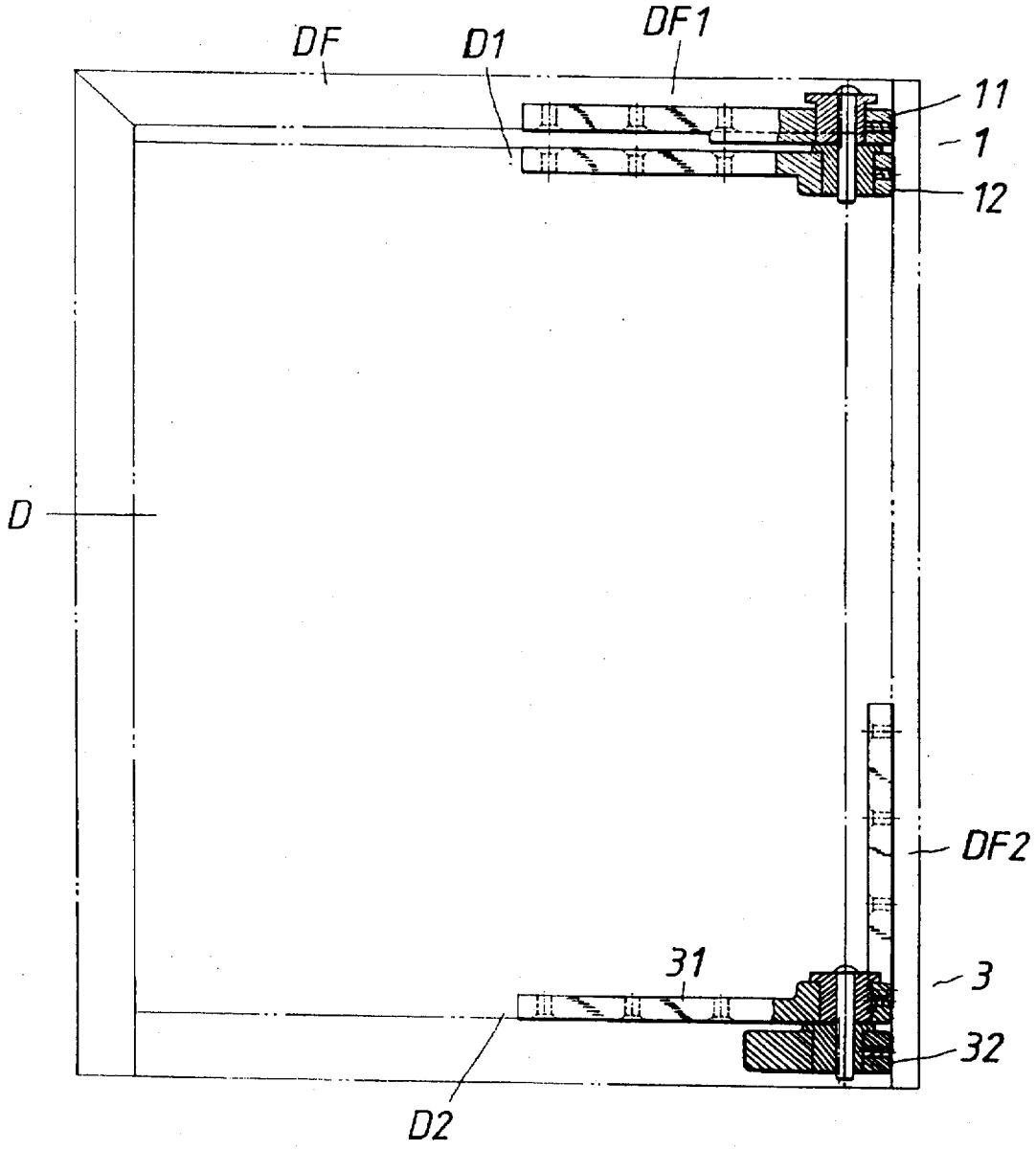
FIG. 2 is an installed view of a door hinge structure according to a second embodiment of the present invention.
Figure 3:
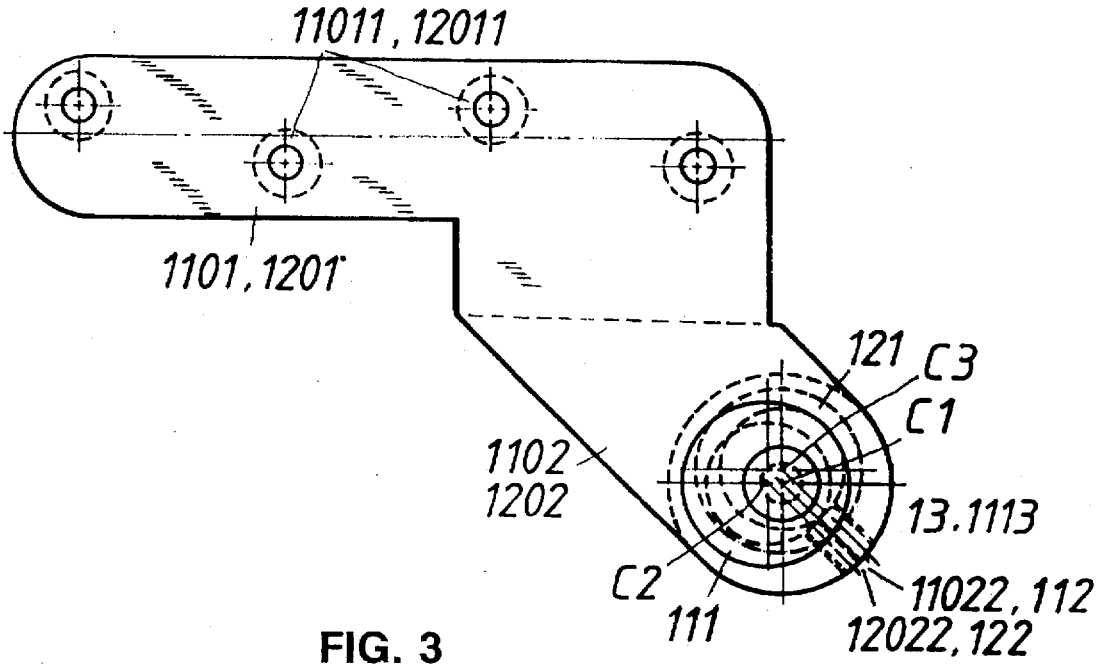
FIG. 3 is a perspective top view of a top door hinge according to the present invention.
Figure 4:
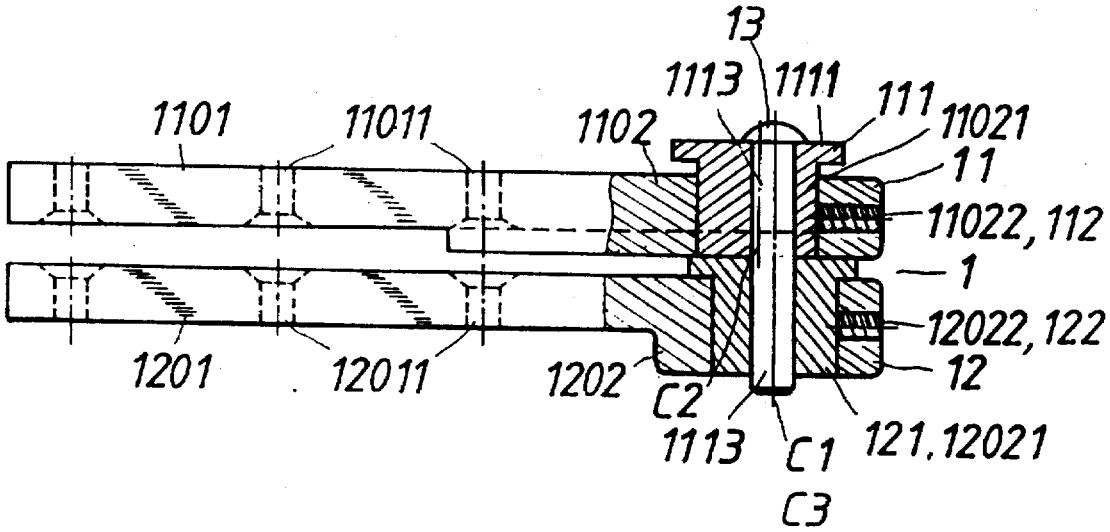
FIG. 4 is a front view in section of the top door hinge shown in FIG. 3.
Figure 5:
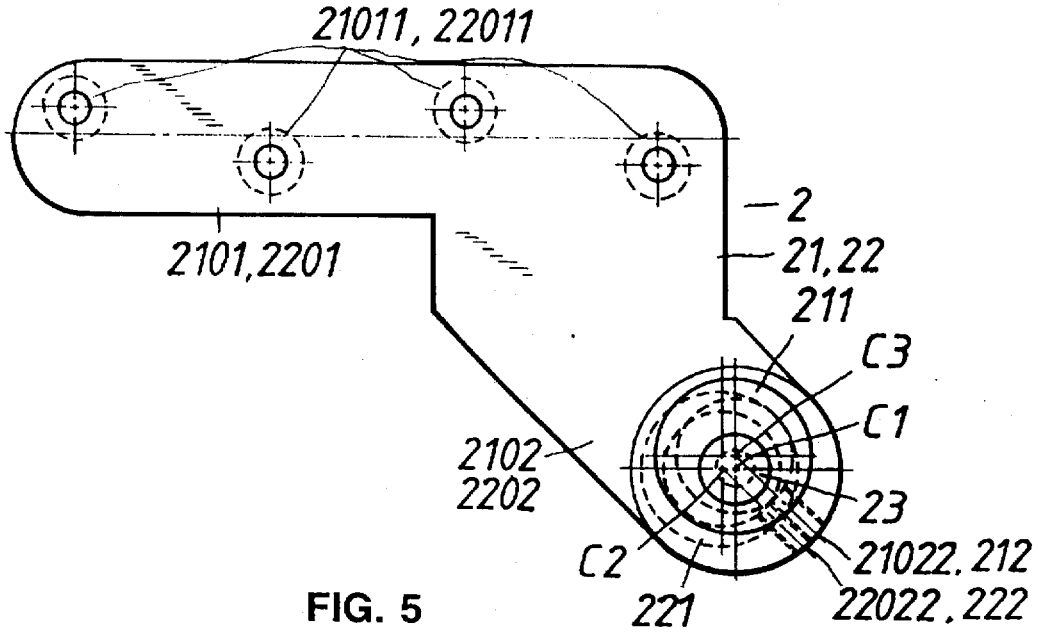
FIG. 5 is a perspective top view of a bottom door hinge according to the first embodiment of the present invention.
Figure 6:
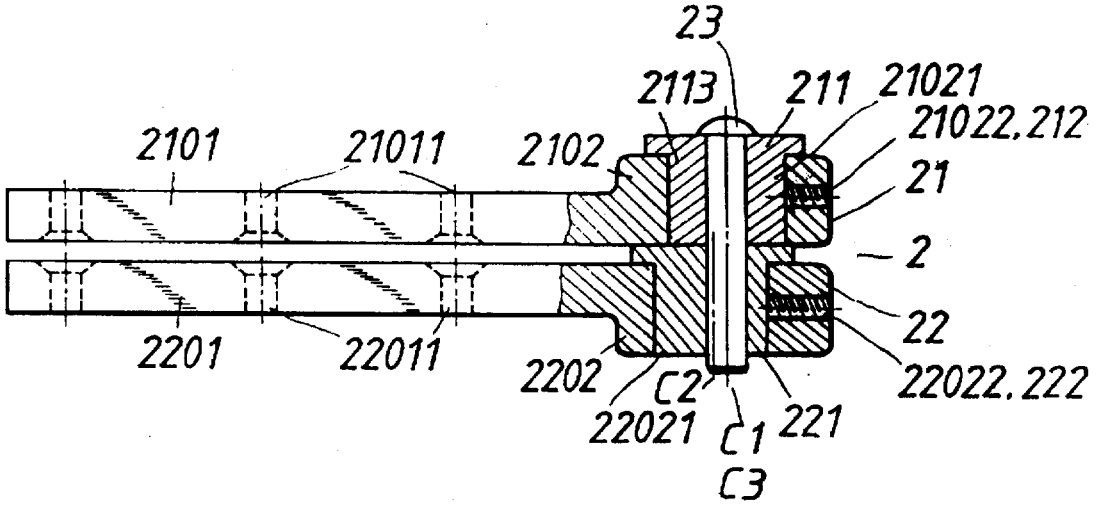
FIG. 6 is a front view in section of the bottom door hinge shown in FIG. 5.
Figure 7:
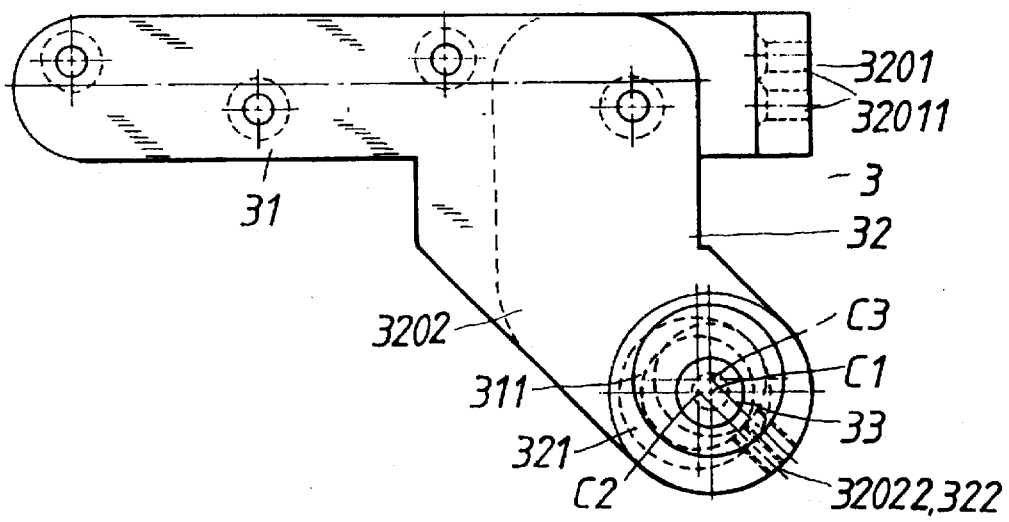
FIG. 7 is a perspective top view of a bottom door hinge according to the second embodiment of the present invention; and, FIG. 8 is a front view in section of the bottom door hinge shown in FIG. 7.
Figure 8:
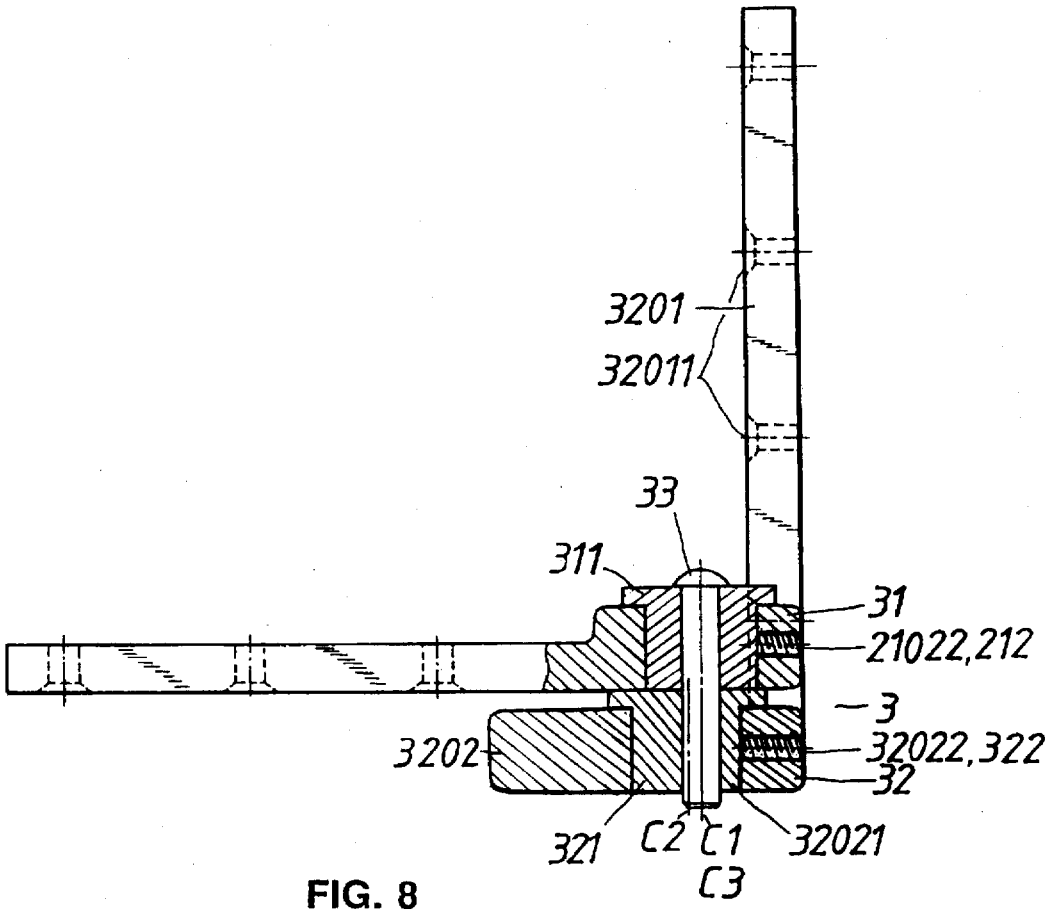

FIGS. 2, 7, and 8 show an alternate form of the present invention adapted for use in a door without having a doorsill. This embodiment is adapted for use in a door having a doorsill. This embodiment comprises a top door hinge 1 and a bottom door hinge 3 respectively connected between a door panel D and a door frame DF at different elevations, for permitting the door panel D to be turned relative to the door frame DF. The structure of the top door hinge 1 is identical to the top door hinge I of the aforesaid first embodiment of the present invention, therefore same reference number is used. The bottom door hinge 3 comprises a first leaf 31 and a second leaf 32 pivotably connected together. The first leaf 31 is adapted for fastening to the bottom side D2 of the door panel D by screws. The structure of the first leaf 31 is identical to the first leaf 21 of the bottom door hinge 2 of the aforesaid first embodiment of the present invention. The second leaf 32 comprises a flat leaf body 3201 and a leaf base 3202 connected at right angles. The leaf body 3201 has a plurality of screw holes 32011 fastened to the door frame DF near its bottom side DF2 by screws. The leaf base 3202 has one end connected to the leaf body 3201 at right angle, and an opposite end terminating in a half-round portion. A vertical axle hole 32021 is made through the half-round portion of the leaf base 3202. The center C2 of the vertical axle hole 32021 is biased from the center C1 of the half-round portion of the leaf base 3202. A horizontal screw hole 32022 is made on the half-round portion of the leaf base 3202, and perpendicularly disposed in communication with the vertical axle hole 32021. A bushing 321 is mounted within the vertical axle hole 32021. A tightening up screw 322 is threaded into the horizontal screw hole 32022 to fix the bushing 321 in place. A headed pivot pin 33 is fastened to the bushings 311 and 321 to connect the first leaf 31 and the second leaf 32 together.

When the door panel D is attached to the door frame DF during the installation of top door hinge I and the bottom door hinge 2, the bushings 111, 221 of the leaves 11, 22 can be turned to change the position of the pivot pin 13, 33, permitting the pitch between the door panel D and the door frame DF to be adjusted forwards and backwards. When the pitch between the door frame DF and the door panel D is well adjusted, the bushings 111, 221 are respectively fixed in position by the respective tightening up screws 112, 222. When the bushings 121, 211 of the leaves 12, 21 are turned to change the position of the pivot pin 13, 23, the pitch between the door panel D and the door frame DF is adjusted leftwards and rightwards. When the pitch between the door frame DF and the door panel D is well adjusted, the bushings 121, 211 are respectively fixed in position by the respective tightening up screws 122, 212.

It is to be understood that the drawings are designed for purposes of illustration only, and are not intended as a definition of the limits and scope of the invention disclosed.

What the invention claimed is:

1. A door hinge structure comprising a first door hinge and a second door hinge connected between a door panel and a door frame at different elevations, for permitting the door panel to be turned relative to the door frame, wherein:

said first door hinge comprises a first leaf having a flat leaf body at one end and a leaf base at an opposite end, the leaf body of the first leaf of said first door hinge having a plurality of screw holes adapted for fastening to the door frame, the leaf base of the first leaf of said first door hinge having one end obliquely connected to the leaf body of the first leaf of said first door hinge, and an opposite end terminating in a half-round portion, the half-round portion of the first leaf of said first door hinge having a vertically disposed eccentric hole and a horizontal screw hole perpendicularly disposed in communication with the eccentric hole; a first bushing mounted within the eccentric hole of the first leaf of said first door hinge and having an eccentric through hole; a first tightening up screw threaded into the horizontal screw hole of the first leaf of said first door hinge to fix the first bushing of said first door hinge in place; a second leaf having a flat leaf body at one end and a leaf base at an opposite end, the leaf body of the second leaf of said first door hinge having a plurality of screw holes adapted for fastening to the door panel, the leaf base of the second leaf of said first door hinge having one end obliquely connected to the leaf body of the second leaf of said first door hinge; and an opposite end terminating in a half-round portion, the half-round portion of the second leaf of said first door hinge having a vertically disposed eccentric hole and a horizontal screw hole perpendicularly disposed in communication with the eccentric hole; a second bushing mounted within the eccentric hole of the second leaf of said first door hinge and having an eccentric through hole; a second tightening up screw threaded into the horizontal screw hole of the second leaf of said first door hinge to fix the second bushing of said first door hinge in place; and a pivot pin fastened to the eccentric through holes of the first bushing and second bushing of said first door hinge to secure the first leaf and second leaf of said first door hinge together, permitting them to be turned relative to each other;

said second door hinge comprises a first leaf having a flat leaf body at one end and a leaf base at an opposite end, the leaf body of the first leaf of said second door hinge having a plurality of screw holes adapted for fastening to the door panel, the leaf base of the first leaf of said second door hinge having one end obliquely connected to the leaf body of the first leaf of said second door hinge, and an opposite end terminating in a half-round portion, the half-round portion of the first leaf of said second door hinge having a vertically disposed eccentric hole and a horizontal screw hole perpendicularly disposed in communication with the eccentric hole; a first bushing mounted within the eccentric hole of the first leaf of said second door hinge and having an eccentric through hole; a first tightening up screw threaded into the horizontal screw hole of the first leaf of said second door hinge to fix the first bushing of said second door hinge in place; a second leaf having a flat leaf body at one end and a leaf base at an opposite end, the leaf body of the second leaf of said second door hinge having a plurality of screw holes adapted for fastening to the door frame, the leaf base of the second leaf of said second door hinge having one end connected to the leaf body of the second leaf of said second door hinge at an angle, and an opposite end terminating in a half-round portion, the half-round portion of the second leaf of said second door hinge having a vertically disposed eccentric hole and a horizontal screw hole perpendicularly disposed in communication with tile eccentric hole; a second bushing mounted within the eccentric hole of the second leaf of said second door hinge and having an eccentric through hole; a second tightening up screw threaded into the horizontal screw hole of the second leaf of said second door hinge to fix the second bushing of said second door hinge in place; and a pivot pin fastened to the eccentric through holes of the first bushing and second bushing of said second door hinge to secure the first leaf and second leaf of said second door hinge together, permitting them to be turned relative to each other.

2. The door hinge structure of claim 1 wherein the flat leaf body of the second leaf of said second door hinge is connected to the leaf base thereof at right angles.

3. The door hinge structure of claim 1 wherein the center of the first bushing of said first door hinge is vertically aligned with the center of the second bushing of said second door hinge; the center of the second bushing of said first door hinge is vertically aligned with the center of the first bushing of said second door hinge.

4. The door hinge structure of claim 1 wherein the distance between the eccentric through holes of the first and second bushings of said first door hinge and the center of the half-round portions of the leaf bases of the first and second leaves of said first door hinge is equal to the distance between the center of the vertical axle holes of the first and second leaves of said first door hinge and the center of the half-round portions of the first and second leaves of said first door hinge.

* * * * *